United States Patent [19]

Tamaki et al.

[11] Patent Number: 4,914,878

[45] Date of Patent: Apr. 10, 1990

[54] MOVABLE PARTITION WALL

[75] Inventors: Shoji Tamaki; Hisami Matusato, both of Osaka, Japan

[73] Assignee: Kokuyo Co., Ltd., Osaka, Japan

[21] Appl. No.: 296,049

[22] PCT Filed: Mar. 12, 1988

[86] PCT No.: PCT/JP88/00261

§ 371 Date: Dec. 29, 1988

§ 102(e) Date: Dec. 29, 1988

[87] PCT Pub. No.: WO88/07113

PCT Pub. Date: Sep. 22, 1988

[30] Foreign Application Priority Data

Mar. 14, 1987 [JP] Japan ..... 62-59222

[51] Int. Cl.[4] ..... E04B 2/74

[52] U.S. Cl. ..... 52/239; 52/36; 52/241; 160/135; 160/351

[58] Field of Search ..... 52/239, 241, 243, 281, 52/285, 36; 160/135, 351

[56] References Cited

U.S. PATENT DOCUMENTS

| | | | |
|---|---|---|---|
| 3,330,084 | 7/1967 | Russell | 52/241 X |
| 3,766,696 | 10/1973 | Totoonchie | 52/241 |
| 3,871,153 | 3/1975 | Birum, Jr. | 52/239 X |
| 4,035,972 | 7/1977 | Timmons | 52/241 |
| 4,104,838 | 8/1978 | Hage et al. | 52/239 |
| 4,109,430 | 8/1978 | Fuller | 52/241 X |
| 4,120,124 | 10/1978 | Temple et al. | 52/36 X |
| 4,250,676 | 2/1981 | Diesby | 52/239 X |
| 4,269,005 | 5/1981 | Timmons | 52/241 X |
| 4,424,654 | 1/1984 | Anderson et al. | 52/239 |
| 4,567,698 | 2/1986 | Morrison | 52/239 X |
| 4,571,907 | 2/1986 | DeFouw et al. | 52/239 |
| 4,601,137 | 7/1986 | Bates | 52/239 X |

FOREIGN PATENT DOCUMENTS

| | | | |
|---|---|---|---|
| 502387 | of 1951 | Belgium | 52/241 |
| 48-54606 | of 1973 | Japan . | |
| 51-10572 | of 1976 | Japan . | |
| 59-106914 | of 1984 | Japan . | |
| 2159852 | 12/1985 | United Kingdom | 52/239 |

*Primary Examiner*—Richard E. Chilcot, Jr.
*Attorney, Agent, or Firm*—Fidelman & Wolffe

[57] ABSTRACT

A movable partition wall comprising a plurality of panels connected together. A pillar may be interposed between adjacent panels so that the panels are connected together with downwardly bent connecting claws which engage connecting holes in the pillar. An upper horizontal surface of each panel is provided with a ridge or groove having tapered side surfaces. A connector is provided which bridges the horizontal surfaces of adjacent panels and which is provided with a tapered portion which communicates with the corresponding ridge or groove on the panels. In the event that a pillar is used, a bolt is inserted through a central portion of the connector and is screwed into a nut supported on the pillar.

10 Claims, 10 Drawing Sheets

MOVABLE PARTITION WALL

TECHNICAL FIELD

This invention relates to a movable partition wall to be installed on a floor with its upper end being kept free, that is, a movable partition wall such as the one called a low partition wall used for simple and easy partitioning in an office room and the like.

TECHNICAL BACKGROUND

Among known movable partition walls of this type there is one which comprises a panel provided at one connecting end thereof with an integrally formed pillar having connecting holes and at the other end thereof with connecting hooks bent downwardly, which engage the connecting holes in the pillar of an adjacent panel thereby to connect the two adjacent panels.

In the conventional type, by engaging the connecting hooks of one panel with the connecting holes of an adjacent panel it is possible to have a plurality of panels successively connected to form a wall of a desired length.

With this conventional arrangement, however, if there exists a play in the engagement of the connecting hooks with the connecting holes, a phenomenon of lateral bending is likely to take place at the connection between adjacent panels, so that the connected panels may move laterally in the direction of their thickness. Therefore, a problem arises that it is difficult to construct a rigid partition wall which is not deformed by an external force.

As a measure to solve the above problem a rectangular platelike connector having a required bending strength may be placed on the upper end surfaces of two adjacent panels, so that the opposite end portions of the connector may be fastened by bolts to the corresponding upper end surfaces of the panels. For such fastening, however, bolts mass-produced by forging are usually used with a resulting disadvantage. The bolts mass-produced by forging have adjacent their head a stem portion the diameter of which is substantially the same as the minor diameter of the threaded portion. On the other hand, it is essential that the holes formed in the above-mentioned connector for a bolt to extend therethrough should have a diameter corresponding to the major diameter of the threaded portion of the bolt. Therefore, under the condition that the bolts fasten the connector to the panels, a gap must exist between the inner circumference of each hole and the outer circumferential surface of the stem portion of the bolt adjacent the head. As a result, the connector is fixed to the upper end surfaces of the panels only by surface friction caused by the fastening force of the bolts. With this arrangement, a high strength of connection can be expected for a while after the bolts have been fastened. However, if the component parts have been deformed after they have been used for a long time, the bolts are likely to be loosened, whereupon the connecting force caused by the aforesaid surface friction decreases, so that bending and deformation in the lateral directions at the connection between adjacent panels are likely to occur due to the gap formed between the holes and the bolts.

It is possible to improve the undesirable condition to a certain extent by increasing the number of bolts and deliberately shifting the positions of the holes through which the bolts extend. However, it is difficult to position adjacent panels accurately in such a manner. Moreover, such an arrangement would disadvantageously require more holes and bolts thereby to increase the number of steps for machining and assembly.

This invention has been proposed in view of the above problems, and its object is to provide a movable partition wall in which adjacent panels can be accurately positioned and rigidly connected without sudden decrease of the connecting strength due to loosening of the fasteners, and without increase of the number of steps required for machdining and assembling parts.

Another object of the invention is to provide a movable partition wall which can connect pillars and panels securely by using connecting members and enhance the accuracy of assembly of the whole wall.

DISCLOSURE OF THE INVENTION

The invention has adopted the following arrangements to attain the above-mentioned objects.

The movable partition wall of the invention is characterized by the provision of a plurality of panels, a groove formed in the horizontal surface of each of adjacent panels and defined by the opposite tapered inner surfaces, a connector bridging the horizontal surfaces of the adjacent panels and having a tapered portion corresponding to the tapered surfaces of the above-mentioned groove fitted therein, and fasteners for securing the connector to the horizontal surfaces of the above-mentioned adjacent panels.

The above-mentioned groove may be replaced by a ridge formed on the horizontal surface of each panel and having tapered outer surfaces, which are engaged by the tapered portion formed in the connector corresponding to the tapered surfaces of the ridge.

In embodying the invention, a pillar may be or need not be interposed between adjacent panels. The number of the panels to be used is not limited to two, but three or four panels can also be used. In particular, where three panels are connected to form a T-shape, a connector T-shaped in plane view is used, and where four panels are connected to form a cruciform shape, a connector cruciform in plane view is used. The manner of connecting two panels is not limited to a linear connection, but two panels may also be connected to form an L shape.

With the above-mentioned arrangement, the tapered portion of the connector engages the groove having opposite tapered inner surfaces or the ridge having opposite tapered outer surfaces. The panels are connected in a posture corrected by the connector with the fasteners providing a fastening force to produce a wedge effect in the connection between the tapered portion and the tapered surfaces. Therefore, such a movable partition wall is highly resistive to deformation caused by an external force acting in the direction of the thickness of the wall, so that a high ability of maintaining its contour can be obtained. With this arrangement, it is not necessary to decide the positions of the panels by fasteners, so that the forged bolts which have no positioning ability as fasteners can be used without any trouble. With positioning provided by engagement of the tapered surfaces, if the fastening force of the fasteners has been reduced more or less due to deterioration of the materials, their positioning ability is not deteriorated suddenly. Therefore, the rigidity of the whole partition wall can be maintained for a long time. As a result, if shelf plates or desk top plates are cantilevered on the movable partition wall, the whole wall is not likely to be deformed easily.

When a pillar is to be interposed between adjacent panels, the following arrangement is preferably adopted. In particular, when a pillar provided with connecting holes in the right and left contacting surfaces thereof and a pair of panels separate from the pillar and provided on the right and left contacting surfaces thereof with connecting claws each having a downwardly bent portion are assembled with the above-mentioned connecting claws engaging the above-mentioned connecting holes so as to connect the adjacent panels through the above-mentioned pillar interposed therebetween, it is particularly preferable that each panel is provided with a groove formed in its upper end surface and defined by opposite tapered inner surfaces, with a connector bridging the upper end surfaces of adjacent panels and having a tapered portion corresponding to the above-mentioned tapered surfaces fitted into the above-mentioned groove, a nut supported adjacent the upper end of the above-mentioned pillar, and a bolt inserted through the middle portion of the above-mentioned connector to be screwed into the above-mentioned nut so that its fastening force pulls the above-mentioned pillar relatively toward the above-mentioned connector.

In the movable partition wall provided with such a pillar, instead of the above-mentioned groove a ridge having tapered outer lateral surfaces may be provided on the upper end surface of the panel, and a tapered portion corresponding to the above-mentioned tapered surfaces may be formed on the connector so as to engage the ridge.

With this arrangement, the following operation and effect are added. As the pillar is pulled toward the connector by the fastening force of the bolts, the panels suppressed by the connector at the upper ends thereof are pushed down relative to the pillar, so that the contacting claws provided on the panels are put deepest into the connecting holes in the pillar. Thus, it is possible to reduce to the minimum dimensional errors caused in assembly by shortage of the depth of engagement of the connecting claws with the connecting holes. With this arrangement, adjacent panels can be securely connected through the pillar and the connector. Thus, the whole wall constructed by connecting a plurality of panels becomes a rigid integral body. Therefore, the wall may be constructed in such a manner that with only the pillars at the opposite ends of the wall in contact with the floor, level adjustment is conducted, after which the adjusters provided on the bottom ends of the intermediate pillars are adjusted so as to bring the intermediate pillars into contact with the floor.

The invention includes a concreate embodiment, wherein the panel comprises an upper frame component, side frame components and a bottom frame component, all made of aluminium and connected into a frame, with a pair of face plates made of a thin iron sheet being affixed to the opposite surfaces of the frame.

With this arrangement, each panel can not only be made light in weight and high in rigidity but also have the following effects. In particular, if face plates made of a thin iron sheet were affixed to the opposite sides of an iron frame to form a panel, the surfaces of the face plates would be likely to be roughened. This is because metal particles are likely to be attached to the surfaces of the frame made of magnetic material such as iron due to residual magnetism and if the face plates were pressed and affixed to the frame with the iron particles remaining thereon, the face plates of a weaker, thin iron sheet would be deformed by the iron particles interposed therebetween. On the contrary, if the frame components are made of aluminium, there is no such disadvantage that metallic particles are affixed to the surfaces of the plates by residual magnetism, and that it is difficult to remove the affixed metallic particles. If adhesive is previously applied to the surface of the frame, on which face plates are pressed with the adhesive in half-cured condition, the grains of the adhesive may constitute foreign bodies like the aforesaid affixed iron particles. However, when the face plates are pressed on the frame, the intervening grains of the adhesive are pushed into the aluminium frame having a lower hardness, so that the iron face plates will not be deformed.

Since the frame components are made of aluminium and provided with a groove or a ridge having tapered surfaces, proper deformation of the frame components results in increased tightness of contact between the tapered surfaces and the tapered portion of the connector. As a result, the effect that the connection between the panels scarcely loosens can be obtained.

BEST MODES OF EMBODYING THE INVENTION

Figure 1:
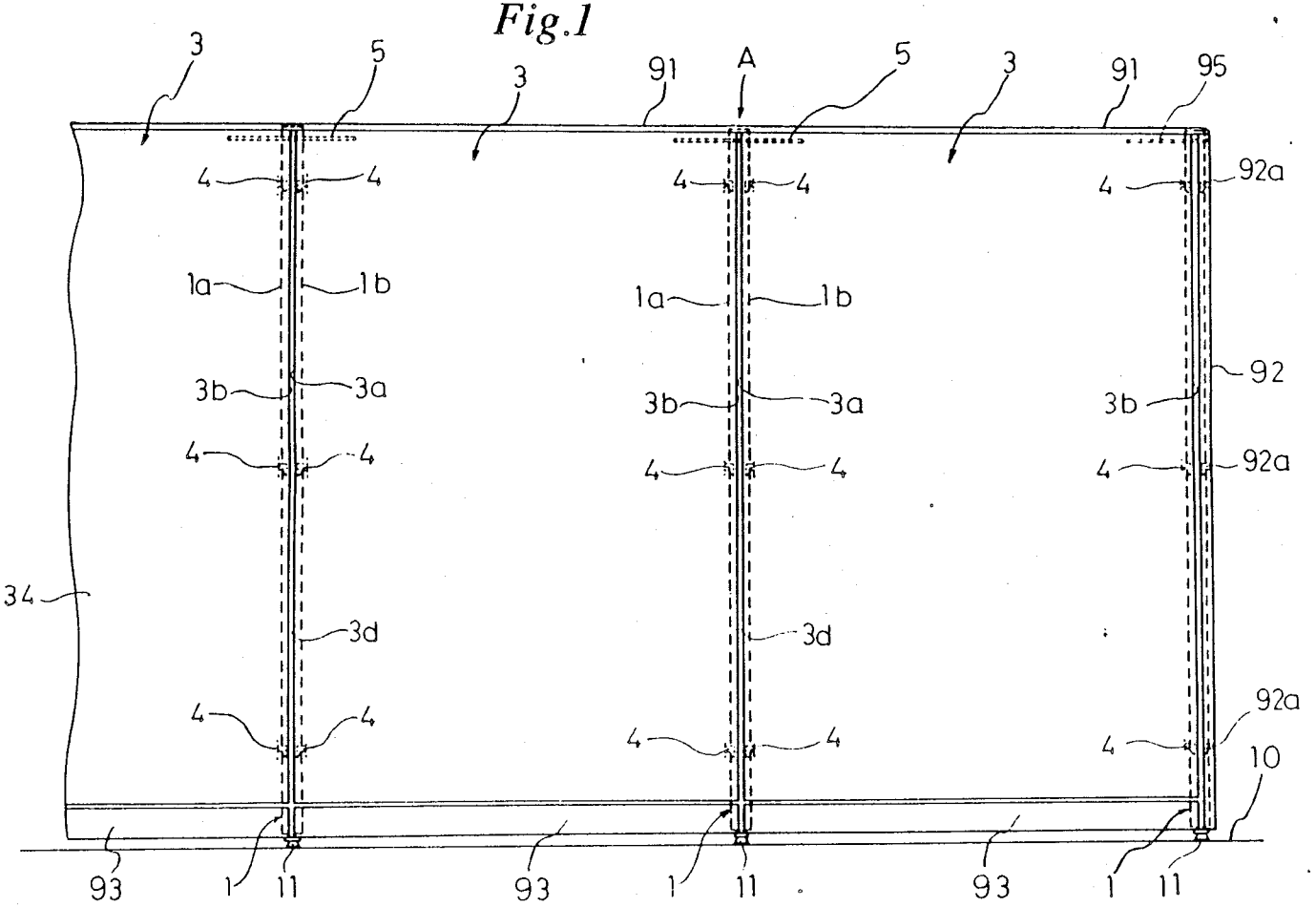
FIG. 1 is a front view.
Figure 3:
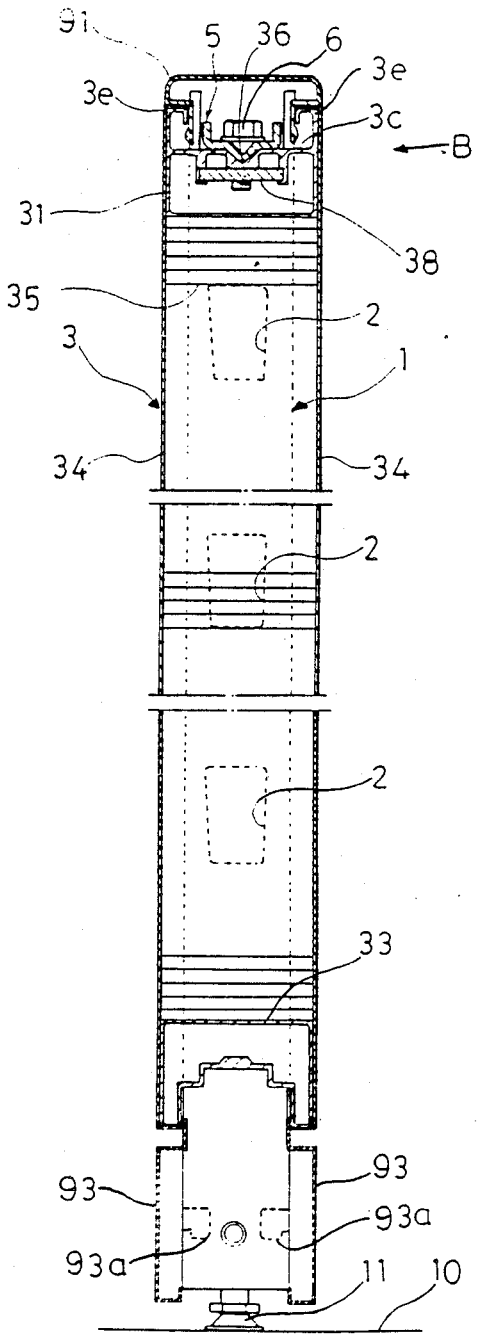
FIG. 3 is a sectional side view of the panel.

One embodiment of the invention will be described with reference to FIGS. 1 through 10.

The movable partition wall is provided with a pillar 1 having a right and a left contacting surface 1*a*, 1*b* with connecting holes 2, and a panel 3 separate from the pillar 1 and having a right and a left contacting surface 3*a*, 3*b* with connecting hooks 4, so that the connecting hooks 4 engage the connecting holes 2, thereby to connect adjacent panels 3 to each other by the pillar 1.

Figure 2:
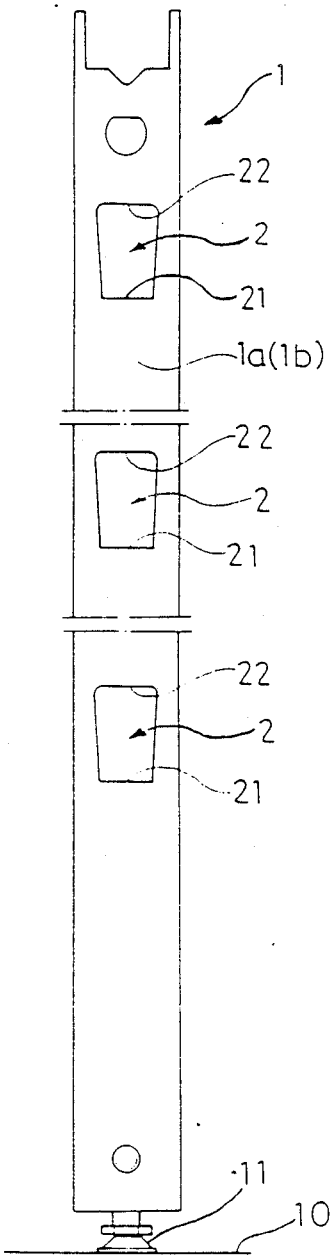
FIG. 2 is a side view of the pillar.
Figure 4:
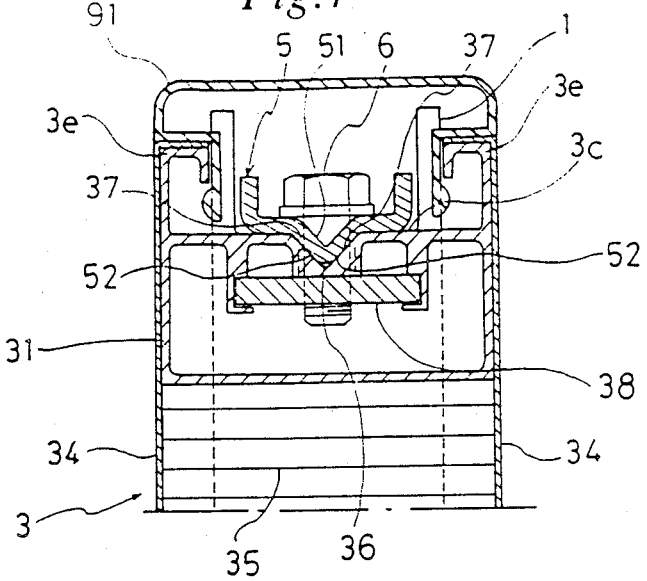
FIG. 4 is an enlarged sectional side view of the "B" portion in FIG. 3.
Figure 5:
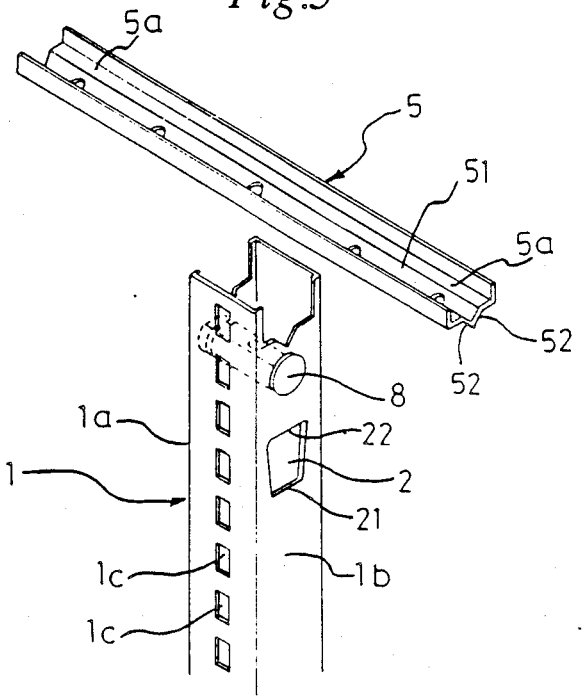
FIG. 5 is a perspective view of the connection in disassembled condition.

As shown in FIGS. 1 and 2, the pillar 1 is made of a rectangular pipe having an adjuster 11 at its bottom end. Each of the right and left contacting surfaces 1*a* and 1*b* of the pillar is formed with a plurality of connecting holes 2 vertically spaced a predetermined distance apart from each other. As shown in FIG. 2, each connecting hole 2 is shaped like an inverted trapezoid the lower edge 21 of which is slightly shorter than the upper edge 22 thereof, and constitutes a through bore communicating the inside of the pillar 1 with the outside thereof.

Figure 6:
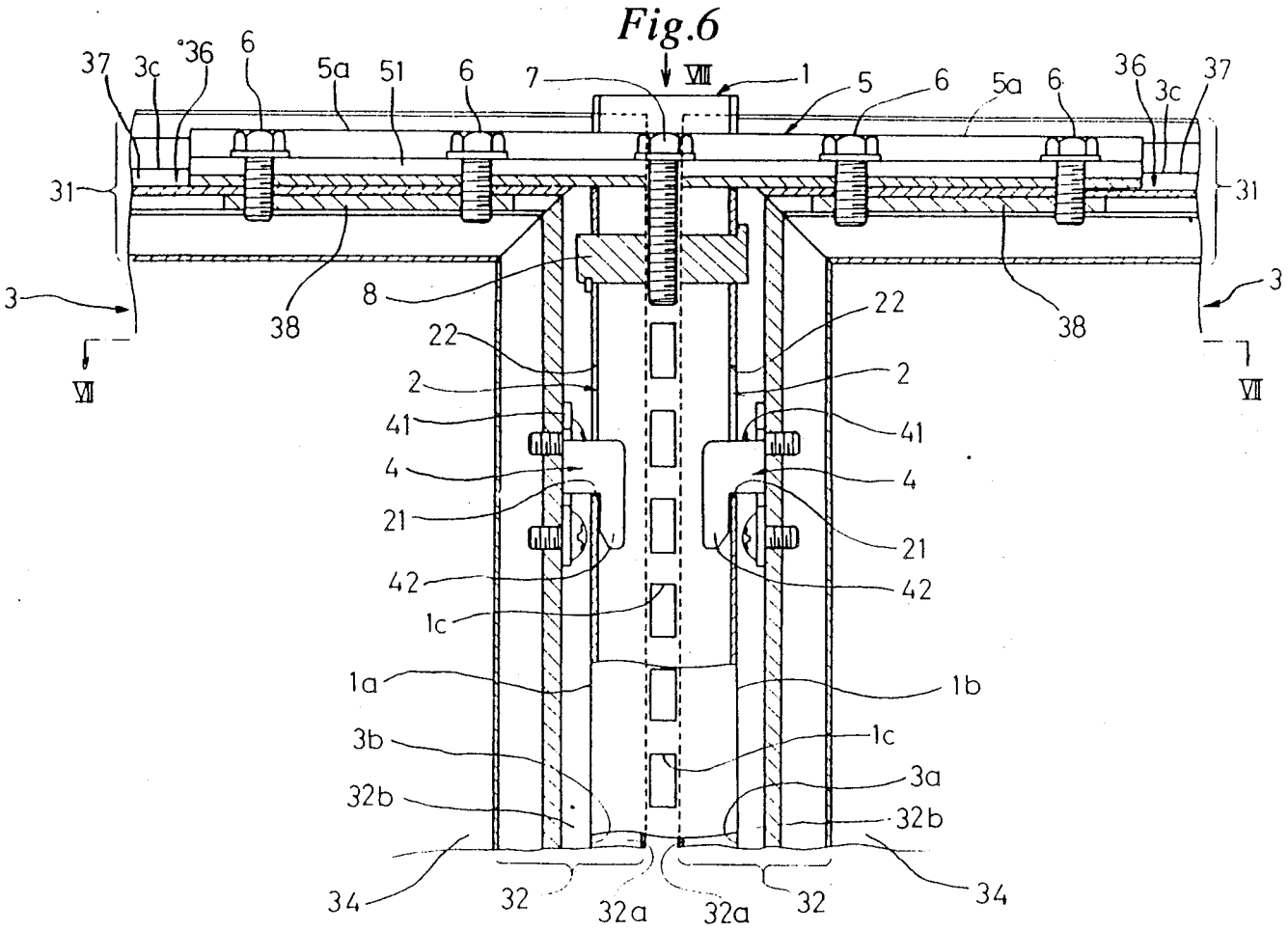
FIG. 6 is an enlarged sectional front view of the interior of the "A" portion in FIG. 1.
Figure 7:
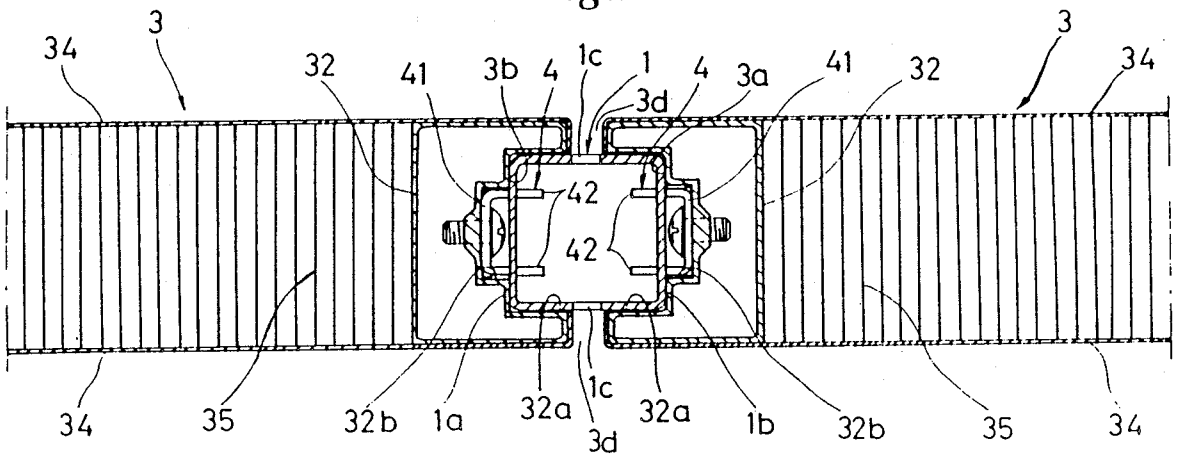
FIG. 7 is a sectional view taken along line VII—VII in FIG. 6.
Figure 8:
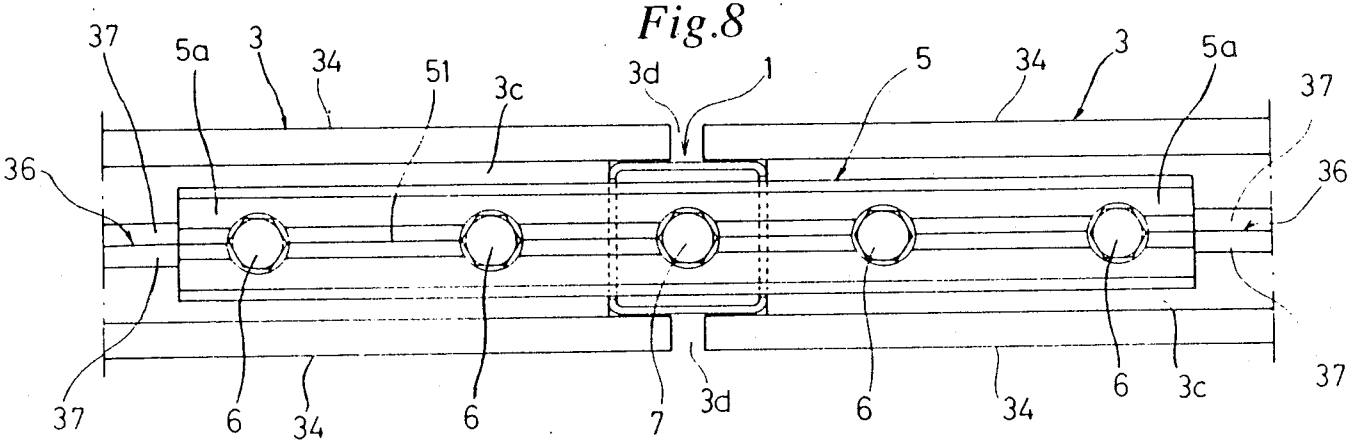
FIG. 8 is a view as viewed in the dirrection of the arrow VIII in FIG. 6.

As shown in FIGS. 1, 3, 6 and 7, the panel 3 comprises an upper frame component 31, side frame components 32 and a lower frame component 34, all made of extruded aluminium and put together to form a frame, to each of the opposite surfaces of which a face plate 34 made of a thin iron sheet is adhered with epoxy adhesive or the like, with core members 35 enclosed therein. The right and left side frame components 32 comprise a rectangular tubular member having an outer surface 1*a*, 1*b* to serve as a contacting surface of the panel 3, in which a wide outer groove 32*a* and a narrow inner groove 32*b* are formed, and the pillar 1 is fitted between the opposite inner lateral surfaces of the outer groove 32*a* as shown in FIG. 7. The connecting hooks 4 are fixed in the above-mentioned inner groove 32*b* at those positions which correspond to the previously mentioned connecting holes 2. As shown in FIGS. 6 and 7, each connecting hook 4 comprises a base plate 41 secured to the bottom surface of the above-mentioned inner groove 32*b* and a pair of claws 42 exftending outwardly from both side edges of the base plate 41. The above-mentioned claws 42 are of an inverted L shape and bent downwardly. The distance between the outer surfaces of the pair of claws 42 projecting from each base plate 41 is set to the same length as the bottom edge 21 of the above-mentioned connecting hole 2.

As shown in FIGS. 4 through 6 and FIG. 8, a connector 5 made of steel extends on the horizontal upper end surfaces 3*c* of adjacent panels 3, and the opposite end portions 5*a* of the connector 5 are secured to the upper frame components 31 of the corresponding panels 3 with a plurality of fasteners, say, two bolts 6, and a bolt 7 penetrating the middle of the connector 5 is screwed into a nut member 8 mounted adjacent the upper end of the above-mentioned pillar 1 thereby to pull the pillar 1 toward the connector 5.

As shown in FIGS. 3 through 6, the connector 5 comprises a channel member U-shaped in cross section, and the middle portion of its bottom wall is protruded to assume a V-shaped contour, with the under surface of the protruded portion 51 being tapered as at 52. On the other hand, the upper surface of the upper frame component 31 of the above-mentioned panel 3 is formed with a groove 36 V-shaped in cross section. The inner surface of the groove 36 is tapered as at 37 in an upwardly diverging manner. When the above-mentioned connector 5 is placed on the upper end surfaces 3*c* of the adjacent panels 3, the tapered portion 52 thereof engages the above-mentioned groove 36. The bolts 6 for fastening the end portions 5*a* of the connector 5 to the above-mentioned panels 3 are screwed into the plate-like nuts 38 supported inside the above-mentioned upper frame component 31.

A number of hook holes 1*c* (not shown in FIG. 1) are formed in the middle portions of the front and rear surfaces of the pillar 1. The hook holes 1*c* are provided for the brackets for supporting shelf plates, desk top plates or the like to be detachably hooked therein, and are exposed in a joint 3*d* formed between adjacent panels 3.

Upstanding edge portions 3*e* are formed along the front and rear edges of the upper end surface 3*c* of each panel 3, and an upper cover 91 engages the edge portions 3*e* so as to cover the upper end surface 3*c* of the panel.

Figure 9:
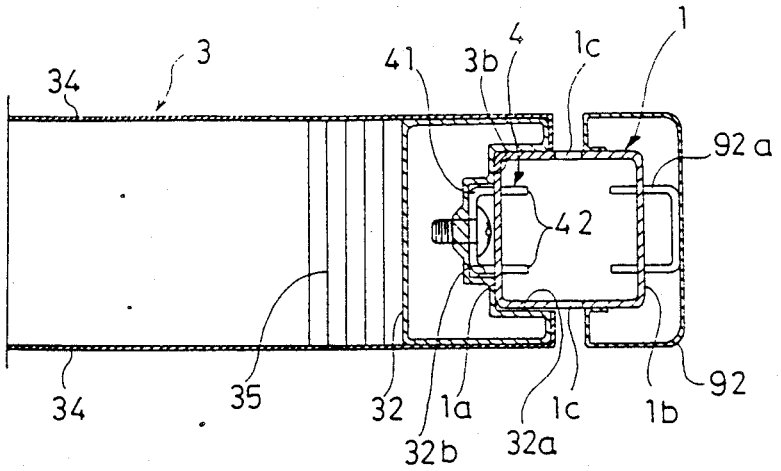
FIG. 9 is a sectional plane view showing the pillar at the extreme end.
Figure 10:
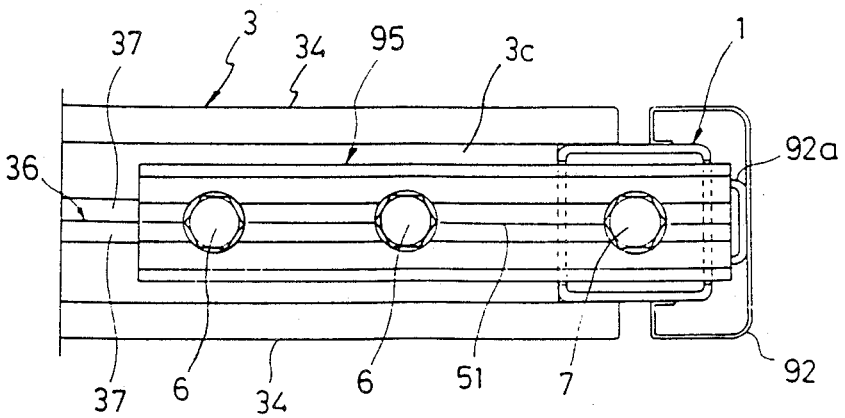
FIG. 10 is a sectional plane view showing of the pillar at the extreme end without the upper cover thereof.

As shown in FIG. 9, a side cover 92 is detachably mounted on the outer lateral side of the pillar 1 at the extreme end of the panel by the connecting claws 92*a* engaging the above-mentioned connecting holes 2. A connector 95 for connecting the panel 3 at the extreme end and the pillar 1 is shown in FIG. 10. In particular, the connector 95 is formed by cutting out one of the opposite end portions 5*a*' of the above-mentioned connector 5, and is fastened to the above-mentioned panel 3 by bolts 6 and connected to the pillar 1 by a bolt 7.

93 is a plinth for covering the space between the lower end of each panel 3 and the floor surface 10. The plinth 93 is detachably fixed to the pillar 1 by engaging claws 93*a* with the above-mentioned hook holes 1*c*.

With this arrangement, since the pillar 1 and the panel 3 are separate, the pillar 1 and the panel 3 may have a symmetrical shape. Therefore, these members can be used in a wider variety of manners compared with the conventional panels of asymmetric shapes. For example, panels of a single type having one surface differently colored from the other may be assembled into a wall of a desired color design by selectively using the differently colored surfaces of the component panels.

With the pillar 1 and the panel 3 completely separated from each other and the downwardly bent connecting claws 4 of each panel 3 engaging the connecting holes 2 in the pillar 1, the assembly error caused by insufficient engagement of the connecting claws 4 with the holes will not be accumulated by increase of the number of panels to be assembled. In particular, in this embodiment the pillar 1 is pulled toward the connector 5 by the fastening force of the bolt 7. As a result, the panel 3 having its upper surface 3*c* pressed down by the connector 5 is pushed downwardly relative to the pillar 1, so that the connecting claws 4 provided on the panel 3 engage the connecting holes 2 to the deepest position. That is, the bent portions 42 of each connecting claw 4 abut on or come very close to the bottom edge 21 of the above-mentioned connecting hole 2, thereby making it possible to decrease to the minimum the assembly error caused by insufficient engagement of the connecting claws 4 with the connecting holes 2.

With this arrangement, adjacent panels 3 can be tightly connected through the pillar 1 and the connector 5, so that the wall itself constructed by connecting a plurality of panels 3 becomes an integral body having a high rigidity.

In particular, the connector 5 having a V-shaped tapered portion 52 is put into the tapered surfaces 37 of the V-shaped grooves 36 of adjacent panels 3, and both the reactive force which pulls the pillar 1 upwardly and the clamping force of the bolt 7 press the connector 5 against the above-mentioned panels 3, so that the adjacent panels 3 with the pillar 1 interposed therebetween are connected with their positions having been corrected by the wedge-like pressing action of the connector 5. Therefore, only if the above-mentioned connector 5 and the groove 36 of each panel 3 are formed straight, the surfaces of all panels 3 are made flush, so that the wall looks very well. Thus, a superior partition wall can be obtained, without appreciable offsetting of the surfaces of the component panels 3 fromm the wall surface even when, for example, light is projected onto the panels 3 at a small incident angle for indirect illumination. With this arrangement, since the ridged portion 5*a* of the above-mentioned connector 5 engages the groove 36 of each panel 3, with the opposite ends 5*a* of the connector 5 being fixed to the panels 3 by the bolts 6, a high strength of connection between the two panels is obtained, and the wall becomes highly resistive to deformation even when an external force is applied to the panel 3 in the direction of the thickness thereof.

Figure 11:
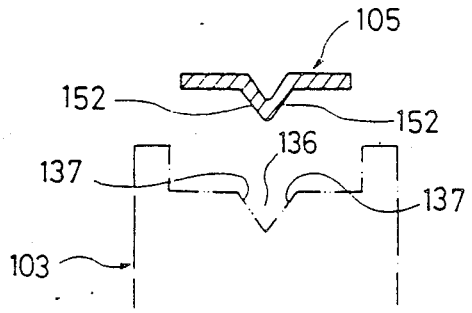
FIGS. 11, 12, 13, 14, 15, 16 and 17 are cross-sectional views schematically showing the connector, respectively.
Figure 12:
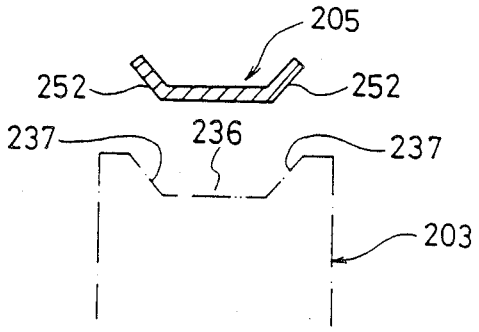
Figure 13:
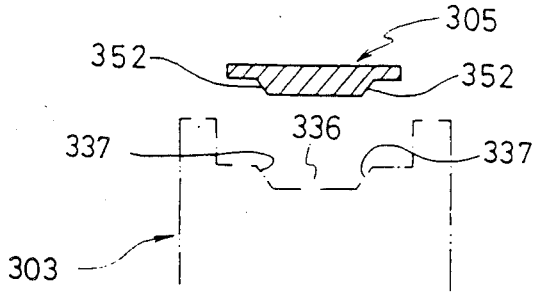
Figure 14:
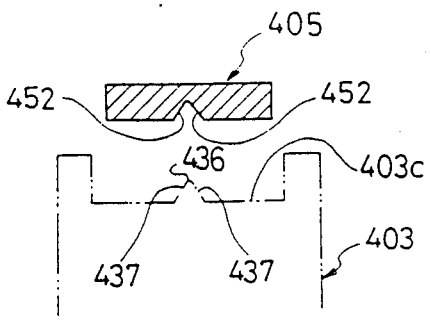
Figure 15:
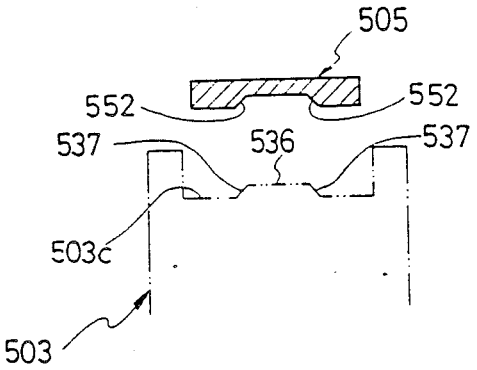
Figure 16:
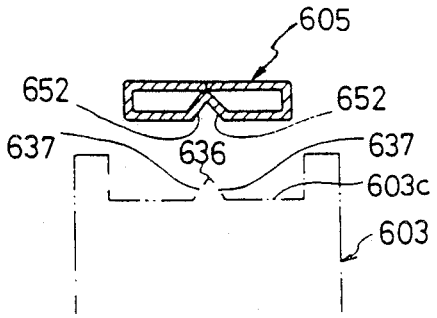
Figure 17:
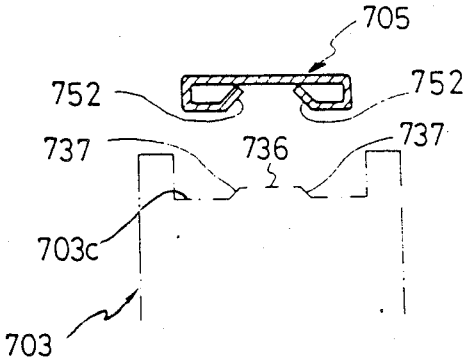
Figure 18:
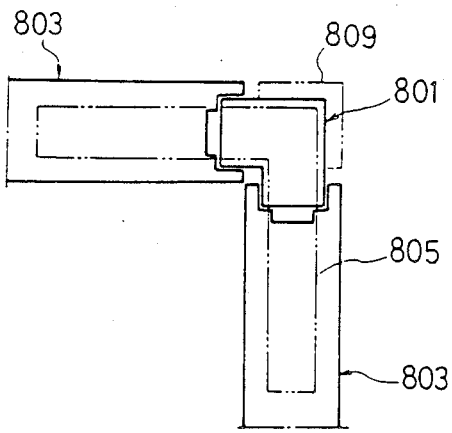
FIGS. 18, 19 and 20 are schematic sectional plane views of the connected portion of the panels.
Figure 19:
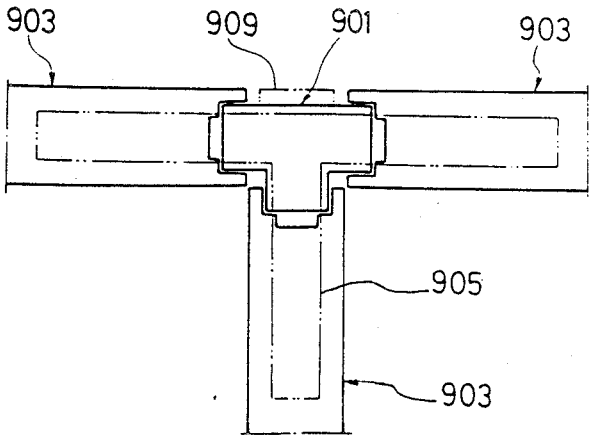
Figure 20:
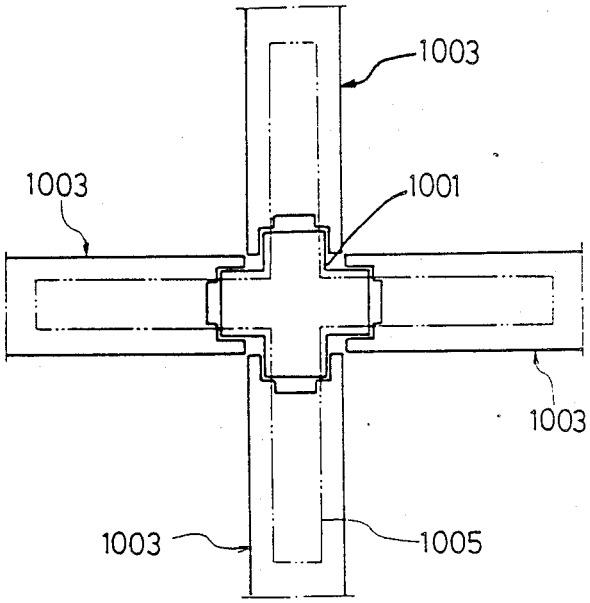

The connector may take various cross-sectional shapes as shown, for example, in FIGS. 11 through 17. In particular, the connector 105 shown in FIG. 11 is fabricated from a plate by bending the middle portion thereof into a V shape so as to provide a tapered portion 152, which is adapted to be brought into engagement with the tapered surfaces 137 of the groove 136 formed in the panel 103. The connector 205 shown in FIG. 12 is fabricated from a plate by bending the opposite edge portions thereof upwardly aslant, with the under surfaces of the bent portions constituting a tapered portion 252, which is adapted to engage the tapered surfaces 237 of a groove 236 formed in the panel 203. The connector 305 shown in FIG. 13 comprises a plate provided at the bottom thereof with a thick portion having tapered surfaces 352 on the opposite lateral sides thereof, which engage the tapered surfaces 337 of a groove 336 formed in the panel 303. The connector 405 shown in FIG. 14 is made of a thick iron plate which is provided in the bottom surface thereof with an inverted V-shaped groove having downwardly diverging tapered surfaces 452. On the other hand, a ridge 436 triangular in cross section is formed on the upper end surface 403*c* of the panel 403. The opposite outer lateral surfaces of the ridge 436 are formed into tapered surfaces 437, and the tapered portion 452 of the above-mentioned connector 405 engages the tapered surfaces 437 of the above-mentioned ridge 436. The connector 505 shown in FIG. 15 is also made of a thick iron plate which is provided in the bottom surface thereof with a trapezoidal groove having downwardly diverging tapered surfaces 552. On the other hand, a ridge 536 trapezoidal in cross section is formed on the upper end surface 503*c* of the panel 503. The opposite outer lateral surfaces of the ridge 536 are formed into tapered surfaces 537, and the tapered surfaces 552 of the above-mentioned connector 505 engage the tapered surfaces 537 of the above-mentioned ridge 536. The connector 605 shown in FIG. 16 is made of a sheet metal which is depressed in the middle portion thereof to provide a V-shaped groove defined by downwardly diverging tapered surfaces 652. On the other hand, a ridge 636 triangular in cross section is formed in the upper end surface 606*c* of the panel 603. The opposite outer lateral surfaces of the ridge 636 are formed into tapered surfaces 637, and the tapered portion 652 of the above-mentioned connector 605 engages the tapered surfaces 652 of the above-mentioned ridge 636. The connector 705 shown in FIG. 17 is fabricated from a sheet metal by bending the opposite lateral edge portions inwardly on the bottom surface thereof so as to form downwardly diverging tapered surfaces 752. On the other hand, a ridge 736 trapezoidal in cross section is provided on the upper end surface 703*c* of the panel 703. The opposite outer lateral surfaces of the ridge 736 are formed into tapered surfaces 737, and the tapered surfaces 752 of the above-mentioned connector 705 engage the tapered surfaces 752 of the above-mentioned ridge 736.

FIGS. 18 through 21 are schematic cross-sectional plane views showing different manners of connecting panels other than the above described linear connections between panels. In the arrangement shown in FIG. 18, the panels 803 are connected through a pillar 801 to form a connection L-shaped in plane view. In this case the upper end surfaces of the wo panels 803 are connected by a connector 805 L-shaped in plane view. The connector 805 has a shape similar in cross section to that of the connector used for linear connection. 809 is a decorative cover. In the arrangement shown in FIG. 19, the panels 903 abut on a pillar 901 in three directions for a connection T-shaped in plane view. In this case the upper end surfaces of the panels 903 are connected by a connector 905 T-shaped in plane view. The connector 905 also has a shape similar in cross section to that of the connector used for linear connection. 909 is a decorative cover. In the arrangement shown in FIG. 20, the panels 1003 abut on a pillar 1001 in four directions for a connection cruciform in plane view. In this case the upper edge surfaces of the panels 1003 are connected by a connector 1005 cruciform in plane view. The connector 1005 also has a shape similar in cross section to that of the connector used for linear connection. When panels are arranged in the manners shown in FIGS. 18 to FIG. 20, it is possible to connect a pillar 1 as shown in FIG. 2 to each panel 803, 903, 1003 separately and connect the pillars by brackets.

Figure 21:
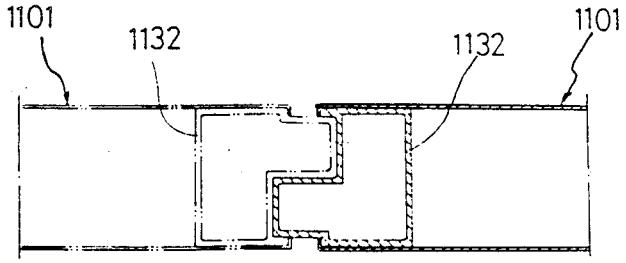
FIG. 21 is a sectional plane view of the connected portion of the panels.

FIG. 21 is a sectional plane view showing an example in which the panels are connected linearly without using a pillar. The side frame component 1132 of the panel 1101 is generally L-shaped in plane view so that the side frame components 1132 of adjacent panels 1101 may mesh with each other. In this case the horizontal surfaces of the two panels 1101 are connected by a connector (not shown) similar to the connectors described above. In this case, to connect the panels 1101 it is not necessary to insert a connecting bolt through the connecting member at the middle thereof so as to be screwed into the pillar, so that the connector need not be porvided with a central hole through which a bolt is to be inserted.

POSSIBILITY OF USE IN INDUSTRY

As described above, the movable partition wall in accordance with the invention is useful as a partition wall for simple and easy partitioning in an office room or the like, and particularly suitable for supporting shelf plates, desk top plates or the like cantilevered on one side surface thereof.

We claim:

1. A movable partition wall comprising:

a plurality of panels, wherein each said panel is provided with a groove formed in an upper horizontal surface thereof, and wherein said groove has tapered side surfaces;

connector means for connecting at least two of said plurality of panels, wherein said connector means bridges the upper horizontal surfaces of said at least two panels, and wherein said connector means is provided with a tapered portion which communicates with said tapered side surfaces of the grooves of said at least two panels; and fastener means for fastening said connector to said upper horizontal surfaces of said at least two panels.

2. The moveable partition wall claimed in claim 1, wherein each said panel comprises an upper frame member, side frame members and a lower frame member, all made of aluminum and combined to form a frame, and face plates made of a thin iron sheet affixed to opposite faces of the frame.

3. A movable partition wall comprising:

a plurality of panels, wherein each said panel is provided with a ridge formed on an upper horizontal surface thereof, and wherein said ridge has tapered side surfaces;

connector means for connecting at least two of said plurality of panels, wherein said connector means bridges the upper horizontal surfaces of said at least two panels, and wherein said connector means is provided with a tapered portion which communicates with said tapered side surfaces of the ridges of said at least two panels; and fastener means for fastening said connector to said upper horizontal surfaces of said at least two panels.

4. The moveable partition wall claimed in claim 3, wherein each said panel comprises an upper frame member, side frame members and a lower frame member, all made of aluminum and combined to form a frame, and face plates made of a thin iron sheet affixed to opposite faces of the frame.

5. A movable partition wall comprising:

a pillar having a plurality of contacting surfaces, wherein each of said plurality of contacting surfaces is provided with a plurality of connecting holes;

a plurality of panels having first and second contacting surfaces, wherein each said panel is provided with a groove formed in an upper horizontal surface thereof, wherein said groove has tapered side surfaces, and wherein first and second contacting surfaces are provided with downwardly bent engaging means for engaging said connecting holes;

connector means for connecting at least two of said plurality of panels, wherein said connector means bridges the upper horizontal surfaces of said at least two panels and an upper surface of said pillar, and wherein said connecter means is provided with a tapered portion which communicates with said tapered side surfaces of the grooves of said at least two panels; and fastener means for fastening said connector to said upper horizontal surfaces of said at least two panels and to said upper surface of said pillar.

6. The moveable partition wall claimed in claim 5, wherein each said panel comprises an upper frame member, side frame members and a lower frame member, all made of aluminum and combined to form a frame, and face plates made of a thin iron sheet affixed to opposite faces of the frame.

7. The moveable partition wall as claimed in claim 5, wherein said connecting holes are of an inverse trapezoidal shape.

8. A movable partition wall comprising:

a pillar having a plurality of contacting surfaces, wherein each of said plurality of contacting surfaces is provided with a plurality of connecting holes;

a plurality of panels having first and second contacting surfaces, wherein each said panel is provided with a ridge formed on an upper horizontal surface thereof, wherein said ridge has tapered side surfaces, and wherein first and second contacting surfaces are provided with downwardly bent engaging means for engaging said connecting holes;

connector means for connecting at least two of said plurality of panels, wherein said connector means bridges the upper horizontal surfaces of said at least two panels and an upper surface of said pillar, and wherein said connector means is provided with a tapered portion which communicates with said tapered side surfaces of the ridges of said at least two panels; and fastener means for fastening said connector to said upper horizontal surfaces of said at least two panels and to said upper surface of said pillar.

9. The moveable partition wall claimed in claim 8, wherein each said panel comprises an upper frame member, side frame members and a lower frame member, all made of aluminum and combined to form a frame, and face plates made of a thin iron sheet affixed to opposite faces of the frame.

10. The moveable partition wall as claimed in claim 8, wherein said connecting holes are of an inverse trapezoidal shape.

* * * * *